United States Patent [19]

Hoffman

[11] 4,034,829

[45] July 12, 1977

[54] STEP STOOL

[76] Inventor: Paul J. Hoffman, 155 E. Haskel St., West St. Paul, Minn. 55118

[21] Appl. No.: 697,872

[22] Filed: June 21, 1976

[51] Int. Cl.[2] ..... A47C 9/12; E06C 7/00

[52] U.S. Cl. ..... 182/106; 182/113; 182/115; 182/107

[58] Field of Search ..... 182/106, 172, 110, 116, 182/115, 113; 52/182

[56] References Cited

U.S. PATENT DOCUMENTS

| | | | |
|---|---|---|---|
| 1,759,424 | 5/1930 | Strauss | 182/106 |
| 2,008,582 | 7/1935 | Fredriksen | 182/172 |
| 2,143,783 | 1/1939 | Liebman | 182/110 |
| 2,584,742 | 2/1952 | Schilling | 182/106 |
| 2,988,164 | 6/1961 | Carlson | 182/106 |
| 3,428,146 | 2/1969 | Bair | 182/106 |
| 3,578,110 | 5/1971 | Seagraves | 182/106 |
| 3,901,354 | 8/1975 | Grebausky | 182/172 |

*Primary Examiner*—Reinaldo P. Machado

[57] ABSTRACT

A step stool includes a handrail attached to one side with non-skid steps that make it safe when standing on the step stool. Stabilizing bars are connected to the step stool to prevent it from tipping over due to a user placing his weight on the hand rail when standing on the step stool.

4 Claims, 4 Drawing Figures

STEP STOOL

BACKGROUND OF THE INVENTION

This invention relates to new and useful improvements in articles of furniture, and, more particularly, to a step stool that is freely movable and is stable when used as a seat or as steps to reach articles not accessable to a person from the floor.

The present invention provides a step stool that permits the user freedom to lean against the hand rail provided and not have the fear that the step stool will tip over. When using a step stool many people wish to have the security of being able to lean against the hand rail while reaching for something or doing some task as washing ceilings, walls, painting, cleaning light fixtures, replacing burned out light bulbs, taking down curtains and drapes for cleaning and many other uses too numerous to mention. The present invention provides this protection.

OBJECTS OF THE INVENTION

An object of the present invention is to provide a step stool with a hand rail having a floor engaging stabilizing means to permit the user to lean against the hand rail while using the step stool.

Another object of the present invention is to provide a step stool structure which is of sturdy construction, pleasing appearance and capable of ready manufacture at an economical cost.

Other objects and advantages will become apparant as the disclosure proceeds.

SUMMARY OF THE INVENTION

A step stool with an upstanding rail for grasping by a person including a pair of spaced apart rail support members for engaging the floor at one end thereof, and a hand rail member extending between the other ends of the rail support members and connected therebetween. A frame extends to one side of the upstanding rail and includes a flat upper platform, and a flat lower platform each joined at one side thereof to the upstanding rail. An upper step member is secured to the upper platform, and a lower step member is secured to the lower platform for supporting the user on the step members.

To prevent tilting of the step stool stabilizing means is secured to the frame and includes a stabilizing bar secured to the frame on the side of the hand rail and extending outwardly in angular relation thereto with suction means for retaining the stabilizing means in removably fixed relation to the floor supporting the step stool. The suction means includes a suction cup secured to the stabilizing bar at one end thereof and having its open end adapted for engagement with the floor.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
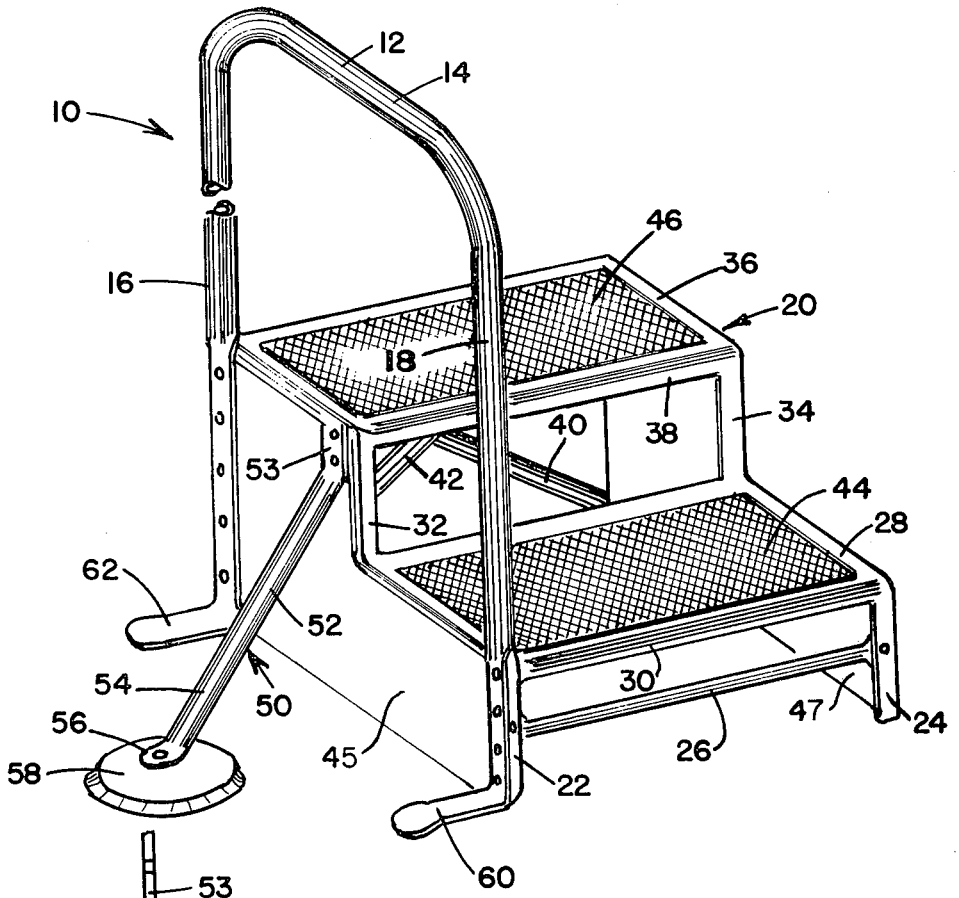
FIG. 1 is a perspective view of a step stool with stabilizing means in accordance with the present invention.

FIGS. 1–4 illustrate the step stool 10 in accordance with the present invention which includes an upstanding rail 12 for grasping by a person. The rail 12 may be of tubular construction in part for facilitating the gripping by the user and the step stool 10 may be made of aluminum or heavy duty plastic or combination thereof.

The rail 12 includes a horizontally extending hand rail member 14 connected at each end to one of a pair of spaced apart rail support members 16 and 18 that extend vertically for engaging the floor at one end of a frame 20 to which it is attached as by rivets or welding.

The frame 20 extends to one side of the hand rail 12 and includes a first pair of upright members 22 and 24. The upright member 22 is connected to the support member 18. A bar 26 joins the upright members 22 and 24. A first platform 28 has a rounded front lip 30 at the front end thereof. The platform is substantially flat and of a size to accommodate the feet of a user standing thereon. Upright connecting members 32 and 34 extend upwardly and connect to a second or top platform 36. A front rounded lip 38 extends across the upper platform 36 and may blend with the upright connecting members 32 and 34.

Figure 2:
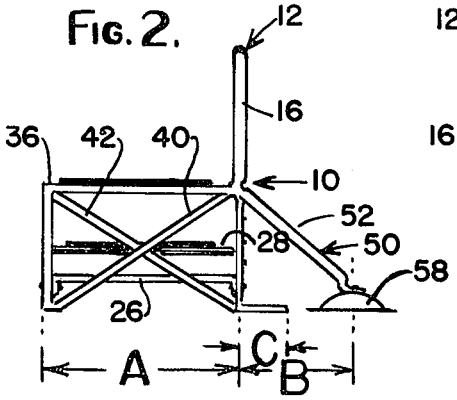
FIG. 2 is a side plan view of the step stool with the stabilizing means.
Figure 3:
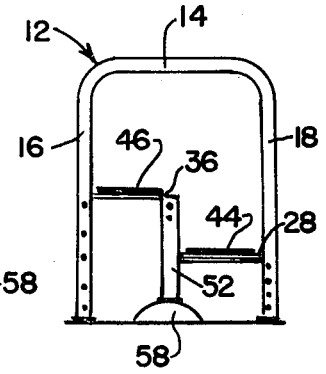
FIG. 3 is a front plan view of the step stool with the stabilizing means.

A pair of cross support members 40 and 42 as seen in FIGS. 1 and 2 give support to the frame 20 to make it more rigid when the user stands upon the upper platform 36. A pair of side panels or skirts 44 and 46 are provided to partially enclose the frame 20 and may be secured thereto in a conventional manner.

The lower platform 28 has a lower step 44 secured thereto and the upper platform has an upper step 46 secured thereto, each made with a non-skid surface for contact with the user.

Figure 4:
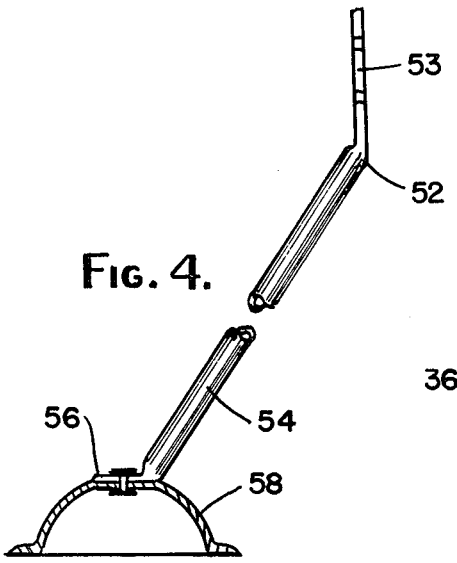
FIG. 4 is a fragmentary enlarged view of the stabilizing arm.

To prevent the step stool 10 from tipping over when the user leans against it for support, stabilizing means 50 is provided. As seen in FIGS. 1 and 4 a stabilizing bar 52 includes a vertically extending flat lug 53 at one end thereof which is secured to the frame 20 at the upright connecting member 32. An angularly disposed tubular support member 54 may be integrally formed with the lug 53 and terminates in a horizontally extending tab 56 that is secured to suction means in the form of a suction cup 58 that is positioned in removably fixed relation to the floor supporting the step stool 10.

To further provide a sturdy step stool 10 that will not tip over in the forward direction or backward direction the stabilizing means is provided with a pair of spaced apart feet or enlarged portions 60 and 62, connecting with upright members 22 and 24 respectively. THe utilization of the feet 60 and 62 further adds to the stability and the dimensional relation is set forth with respect to FIG. 2. The width of the step stool 10 is defined by dimension A. The distance that the support bar 52 extends outwardly is defined by dimension B and the length of the feet defined by the dimension C. The dimensional relationship is that the dimension B should be at least equal to twenty five percent the length of A, with respect to the dimension C the length of the feet 60 and 62 should be equal to a length at least twenty five percent of the dimension B. In this manner a maximum stabilizing effect is obtained of the step stool 10.

It is understood that while I have illustrated and described a certain form of my invention, it is not to be limited to the specific form or arrangement of parts herein described and shown.

I claim:

1. A step stool comprising:

an upstanding rail for grasping by a person including a pair of spaced apart rail support members for engaging the floor at one end thereof, and a hand rail member extending in substantially a horizontal plane between the other ends of the rail support members and connected therebetween, a frame extending to one side of the upstanding rail and including, a flat upper platform extending below said hand rail, and a flat lower platform extending below said upper platform, said platforms each joined at one side thereof to the upstanding rail, an upper step member secured to the upper platform, and a lower step member secured to the lower platform for supporting the user on the step members, stabilizing means secured to said frame and including:

a stabilizing bar secured to said frame on the side of the hand rail and extending outwardly in angular relation thereto, and suction means for retaining the stabilizing means in removably fixed relation to the floor supporting the step stool, said suction means including a suction cup secured to the stabilizing bar at one end thereof and having its open end adapted for engagement with the floor, such that the weight of the user against the rail will prevent tipping of the step stool, said stabilizing bar including:

a vertically extending flat lug at the upper end thereof, an angularly disposed support member, and a horizontally extending tab secured to the suction cup, wherein the stabilizing bar extends outwardly from the hand rail by a dimension equal to at least 25 percent the width of the frame, wherein said stabilizing means further includes a pair of outwardly extending floor engaging feet members connected with and outwardly extending from each rail support member such that additional leverage is obtained against tilting of the step stool by the user, wherein the frame includes:

a first pair of upright members supporting the lower platform, upright connecting members connecting the lower platform to the upper platform, and a pair of side panels enclosing the sides of the frame.

2. A step stool as defined in claim 1, wherein said feet members extend outwardly by a dimension equal to at least twenty five percent of the distance the stabilizing bar extends outwardly from said frame.

3. A step stool as defined in claim 1, wherein the frame further includes cross support members connecting the side panels, and a bar extending between the upright connecting members.

4. A step stool as defined in claim 1, wherein the step members have a non-skid surface for safety of the user.

* * * * *